US009406466B2

(12) United States Patent
Yang

(10) Patent No.: US 9,406,466 B2
(45) Date of Patent: Aug. 2, 2016

(54) EXPANSION CHAMBERS FOR CIRCUIT BREAKERS

(71) Applicant: Siemens Industry, Inc., Alpharetta, GA (US)

(72) Inventor: Guang Yang, Suwanee, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 17 days.

(21) Appl. No.: 14/482,024

(22) Filed: Sep. 10, 2014

(65) Prior Publication Data

US 2016/0071672 A1 Mar. 10, 2016

(51) Int. Cl.
*H01H 33/08* (2006.01)
*H01H 33/70* (2006.01)

(52) U.S. Cl.
CPC ..... *H01H 33/7015* (2013.01); *H01H 33/08* (2013.01)

(58) Field of Classification Search
CPC ..... H01H 2009/305; H01H 2009/347; H01H 2009/348; H01H 33/561; H01H 33/64; H01H 33/08; H01H 33/7015
USPC ..... 218/46, 47, 48, 51, 68, 15, 13, 57; 335/201
See application file for complete search history.

(56) References Cited

U.S. PATENT DOCUMENTS

| | | | | |
|---|---|---|---|---|
| 3,662,133 | A * | 5/1972 | Bould | H02B 11/173 218/151 |
| 4,001,743 | A * | 1/1977 | Arnhold | H01H 73/18 335/201 |
| 4,375,021 | A * | 2/1983 | Pardini | H01H 9/36 218/25 |
| 4,581,511 | A * | 4/1986 | Leone | H01H 73/18 200/306 |
| 7,186,941 | B2 * | 3/2007 | Yeon | H01H 9/302 218/38 |
| 8,164,018 | B2 | 4/2012 | Yang | |

* cited by examiner

*Primary Examiner* — Renee Luebke
*Assistant Examiner* — William Bolton

(57) ABSTRACT

Embodiments include a circuit breaker having first and second electrical contacts, the contacts adapted to generate an electrical arc during separation, at least one of the first and second electrical contacts being a movable electrical contact. The circuit breaker also includes an expansion chamber disposed adjacent to at least one of the first and second electrical contacts such that an arcing space is defined by the first electrical contact and the second electrical contact when the first and second electrical contacts are separated. The expansion chamber includes an opening configured to permit air flow between the arcing space and a chamber of the expansion chamber.

18 Claims, 11 Drawing Sheets

EXPANSION CHAMBERS FOR CIRCUIT BREAKERS

BACKGROUND

The present invention relates generally to circuit breakers, and more specifically to, circuit breakers that include expansion chambers for extinguishing arcs.

In general, a circuit breaker operates to engage and disengage a selected electrical circuit from an electrical power supply. The circuit breaker ensures current interruption thereby providing protection to the electrical circuit from continuous over current conditions and high current transients due, for example, to electrical short circuits. Such circuit breakers operate by separating a pair of internal electrical contacts contained within a housing of the circuit breaker. Typically, one electrical contact is stationary while the other is movable (e.g., mounted on a pivotable contact arm). The contact separation may occur manually, such as by a person throwing a handle of the circuit breaker. This may engage a trip mechanism, which may be coupled to the contact arm and moveable contact. Otherwise, the electrical contacts may be separated automatically when an over current or short circuit condition is encountered. This automatic tripping may be accomplished by a tripping mechanism actuated via a thermal overload element (e.g., a bimetal element) or by a magnetic element (e.g., an actuator).

Upon separation of the electrical contacts by tripping of the circuit breaker, an electrical arc may be formed. This separation may occur due to heat and/or high current through the circuit breaker. It is desirable to extinguish such arc as quickly as possible to avoid damaging internal components of the circuit breaker. In low voltage alternating current (AC) circuit breakers, such as molded case circuit breakers (MCCBs), two methods are commonly used to extinguish arcs. The first method is often referred to as current limiting and it includes actively raising the arc voltage to a level higher than the system voltage, which effectively forces the current to reduce to zero. Commonly used current limiting methods include arc plates, gassing material, long arcs and so on. The second method includes using the natural current zero crossing from AC circuit to prevent re-ignition after current goes to zero. In currently available circuit breakers, due the inductance present in a circuit, a recovery voltage can be induced across the arcing space. If the recovery voltage is high enough, it can re-ignite the extinguished arc and cause failed interruptions.

Accordingly, there is a need for apparatus, systems and methods to extinguish an electrical arc in a circuit breaker resulting from contact separation.

SUMMARY

In one embodiment, a circuit breaker includes first and second electrical contacts, the contacts adapted to generate an electrical arc during separation, at least one of the first and second electrical contacts being a movable electrical contact. The circuit breaker also includes an expansion chamber disposed adjacent to at least one of the first and second electrical contacts such that an arcing space is defined by the first electrical contact and the second electrical contact when the first and second electrical contacts are separated. The expansion chamber includes an opening configured to permit air flow between the arcing space and a chamber of the expansion chamber.

In another embodiment, a method of operating a circuit breaker includes separating a first electrical contact from a second electrical contact upon tripping of the circuit breaker and responsively forming an electrical arc. The method also includes increasing an air pressure in an expansion chamber disposed adjacent to at least one of the first and second electrical contacts in response to a rising current in the electrical arc. An arcing space is defined by the first electrical contact and the second electrical contact when the first and second electrical contacts are in a separated position. The method further includes creating airflow from the expansion chamber into the arcing space through an opening in the expansion chamber in response to a decrease in the air pressure in the arcing space, wherein the airflow acts to cool the electrical arc.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features and advantages of the invention are apparent from the following detailed description taken in conjunction with the accompanying drawings in which:

DETAILED DESCRIPTION

Exemplary embodiments include circuit breakers with an expansion chamber configured to prevent a re-ignition failure of the circuit breakers. In exemplary embodiments, as the arc is formed the air inside the circuit breaker and around the contacts heats up and pressurizes, which causes an airflow into the expansion chamber. After the air pressure in the area around the contacts reaches its peak and begins to drop, air will begin to flow from the expansion chamber back into the area around the contacts. This air flow will cool down the arcing space and will increase dielectric strength of the arcing space. In exemplary embodiments, the air flow on the arc also cools down the arc and increases the arc voltage, thereby providing better current limiting performance.

Figure 1A:
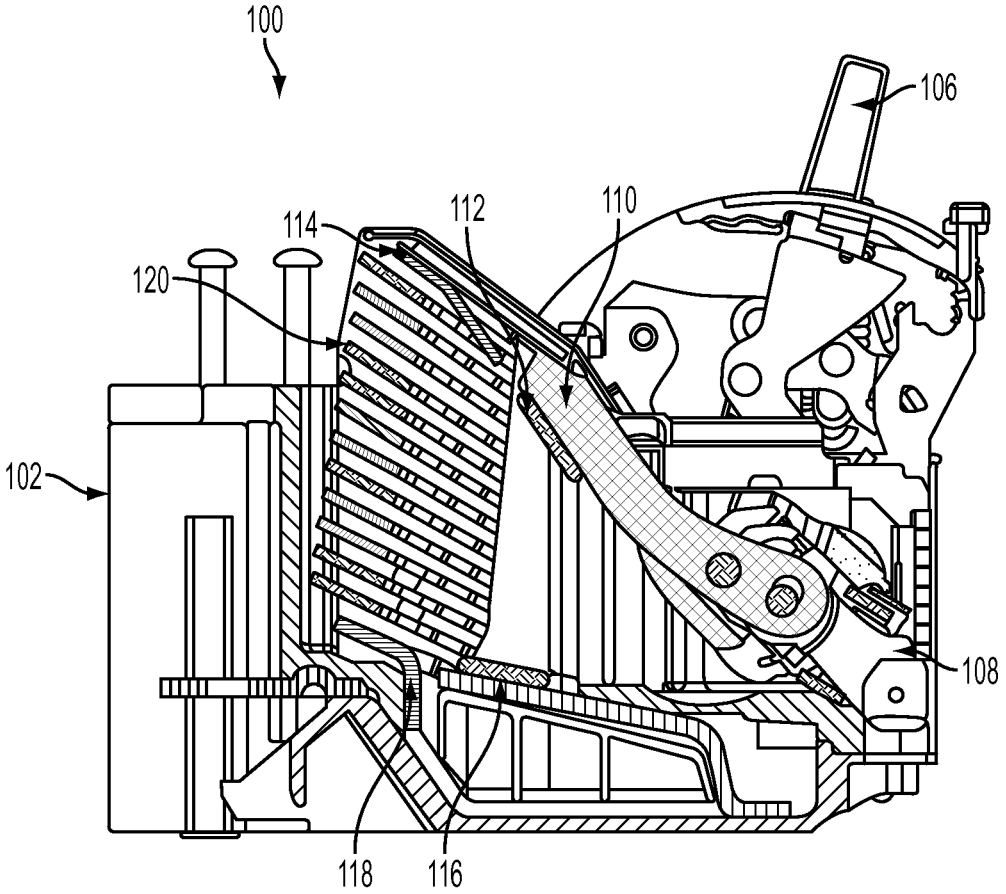
FIG. 1A PRIOR ART
FIGS. 1A and 1B respectively illustrate a cross sectional side view and a cross sectional top view of a traditional circuit breaker.
Figure 1B:
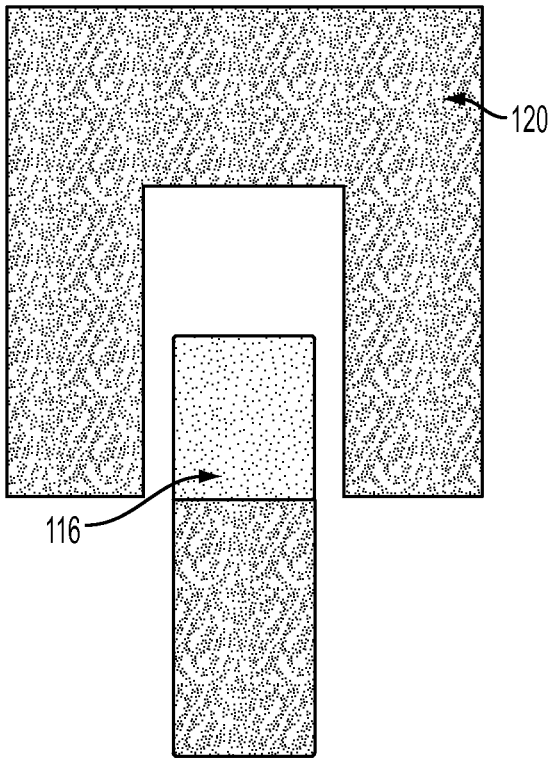
FIG. 1B PRIOR ART

Referring now to FIGS. 1A and 1B a cross sectional side view and a cross sectional top view of a traditional circuit breaker 100 are respectively shown. The circuit breaker 100 includes a housing 102 that may be made up of a number of interconnecting housing sections and may include an arrangement of internal and external walls, which are adapted to contain or retain various components of the circuit breaker 100. While the circuit breaker 100 illustrated is a molded case circuit breaker (MCCB) it will be appreciated by those of ordinary skill in the art that the present invention is applicable to other designs with similar constructions.

In exemplary embodiments, the circuit breaker 100 includes a handle 106 that is operably connected to an operating mechanism 108. The operating mechanism 108 is coupled to an arm 110 that has a moveable contact 112 and an upper arc runner 114 disposed thereon. The circuit breaker 100 also includes a stationary contact 116 and a lower arc runner 118. As best illustrated by FIG. 1A, the circuit breaker 100 includes a plurality of arc plates 120. As best illustrated by FIG. 1B, the arc plates 120 have a u-shape and are disposed around the area containing the stationary contact 116 and the moveable contact 112, such that at least a portion of the moveable contact 112 passes through the u-shaped opening in the arc plates 120 when the circuit breaker trips. As used herein the term arcing space refers to the area between the stationary contact 116 and the moveable contact 112 when the circuit breaker 100 is in the tripped state. When the circuit breaker 100 trips, an arc is between the movable contact 112 and the stationary contact 116 in the arcing space.

Figure 2A:
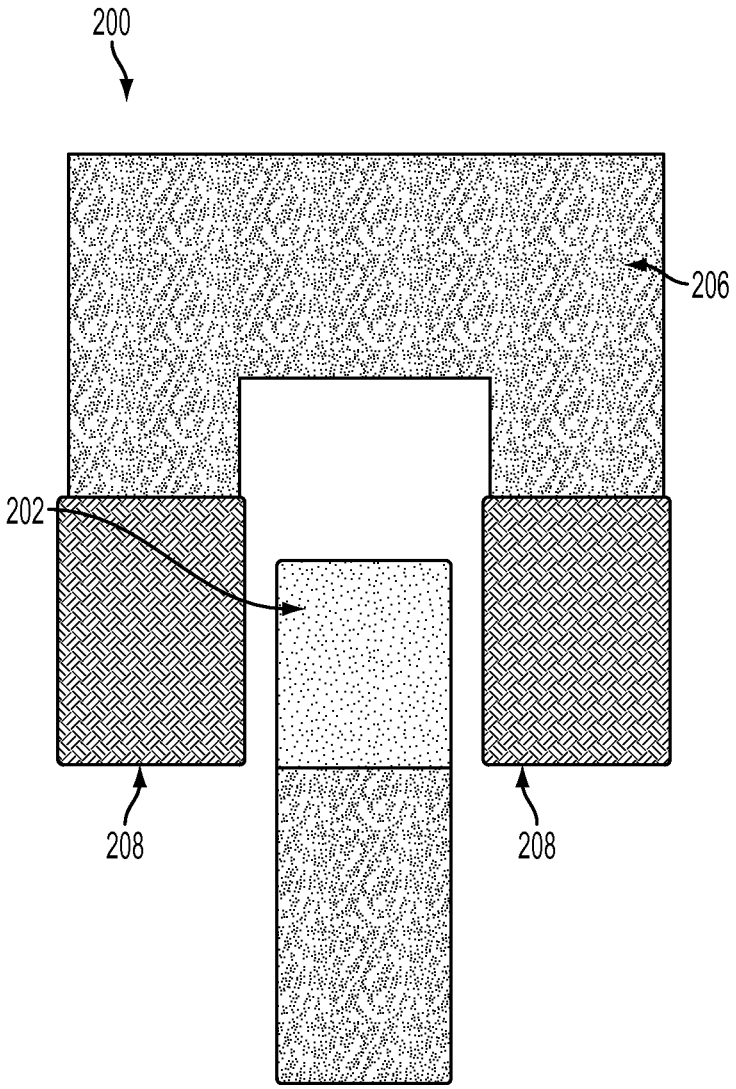
FIG. 2A is a cross sectional top view of a circuit breaker with an expansion chamber in accordance with an exemplary embodiment.
Figure 2B:
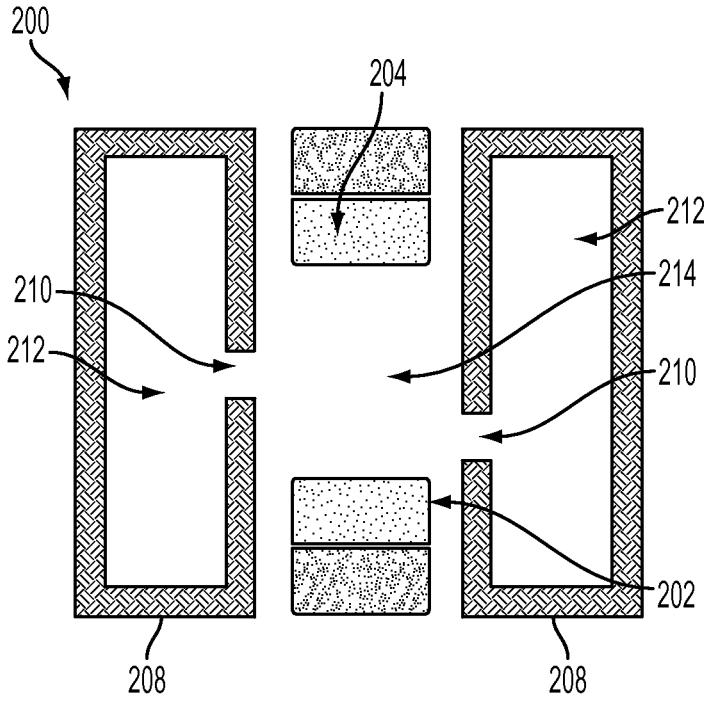
FIG. 2B is a cross sectional side view of a circuit breaker with an expansion chamber in accordance with an exemplary embodiment.

Referring now to FIGS. 2A and 2B, a cross sectional top view and a sectional side view of a portion of a circuit breaker 200 with an expansion chamber in accordance with an exemplary embodiment are respectively shown. As illustrated, the circuit breaker 200 includes a stationary contact 202, a moveable contact 204, an arc plate 206 and one or more expansion chamber 208. In exemplary embodiments, the circuit breaker 200 includes two expansion chambers 208 that are disposed on opposite sides of an arcing space 214 defined by the walls of the expansion chambers 208 and the stationary contact 202 and moveable contact 204 in a separated position.

In exemplary embodiments, each of the expansion chambers 208 includes an opening 210 and a chamber 212. In exemplary embodiments, the openings 210 of the expansion chambers 208 are disposed in staggered locations relative to one another such that the air flows into and out of the arcing space 214 into the chamber 212 at different locations between the stationary contact 202 and the moveable contact 204. In exemplary embodiments, the number, size and locations of the openings 210 and the size of the chamber 212 may be varied depending on the specifications of the circuit breaker 200. In exemplary embodiments, the expansion chambers 208 may be molded from a suitable plastic material, a thermoset material such as glass-filled polyester, or a thermoplastic material such as a Nylon material.

Figure 3:
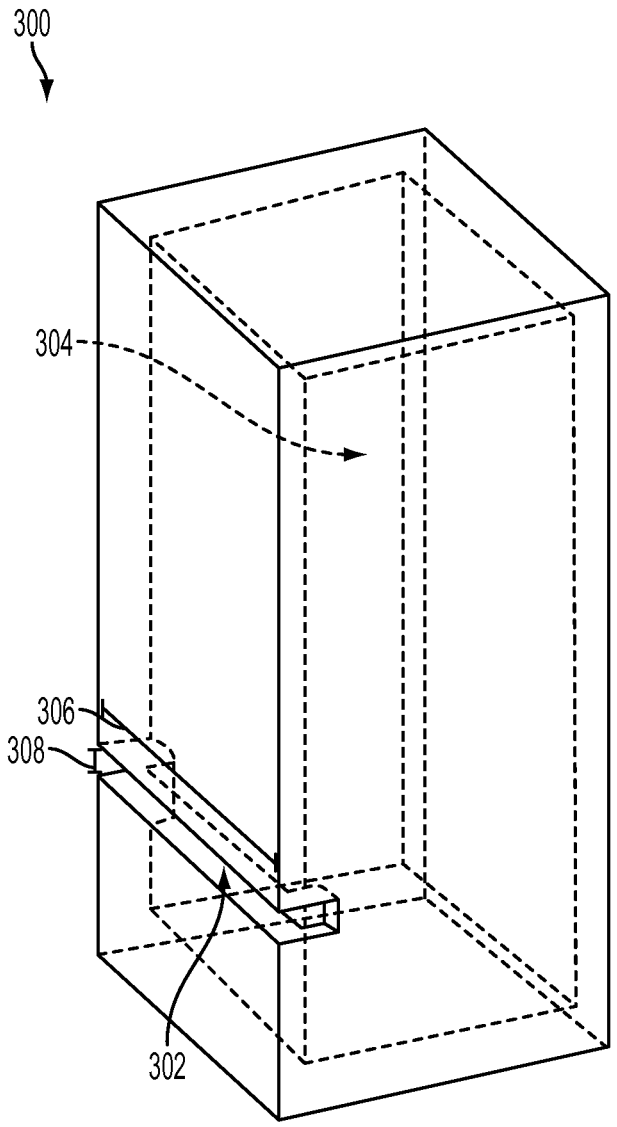
FIG. 3 is a perspective view of an expansion chamber for a circuit breaker in accordance with an exemplary embodiment.

Referring now to FIG. 3, a perspective view of an expansion chamber 300 for a circuit breaker in accordance with an exemplary embodiment is shown. As illustrated, the expansion chamber 300 includes an opening 302 and a chamber 304. In exemplary embodiments, the opening 302 has a length 306 that extends the entire width of the expansion chamber 300 and a height 308. The height 308 is selected based on the desired operating characteristics of both the circuit breaker and the expansion chamber 300. In exemplary embodiments, the length of opening 302 covers the length of the stationary contact with a slot shape. However, as will be appreciated by those of ordinary skill in the art, other shapes and size of the opening 302, such as circle may also be used. In addition, those of ordinary skill in the art will appreciate that the size, number and location of the opening 302 shown is merely exemplary and the number, size and location of the openings 302 may be varied without departing from the present invention.

Figure 4:
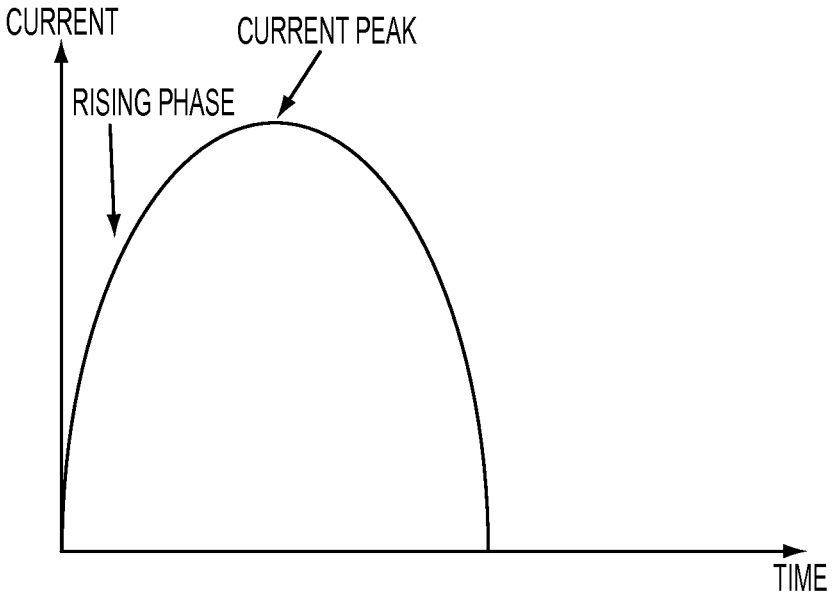
FIG. 4 is a graph illustrating the relationship between a current and time during a fault in a circuit breaker with an expansion chamber in accordance with an exemplary embodiment.
Figure 5B:
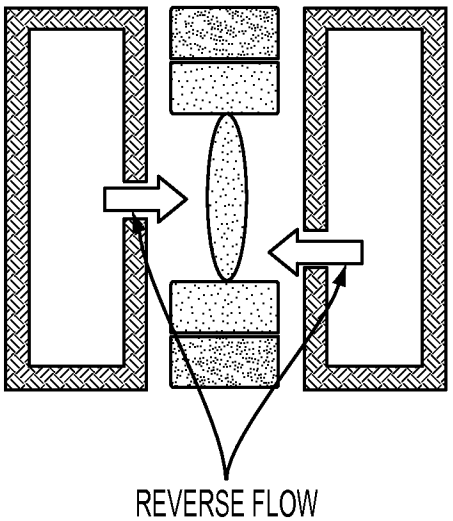
FIGS. 5A and 5B illustrate cross sectional side views of a circuit breaker with an expansion chamber in accordance with an exemplary embodiment.
Figure 5A:
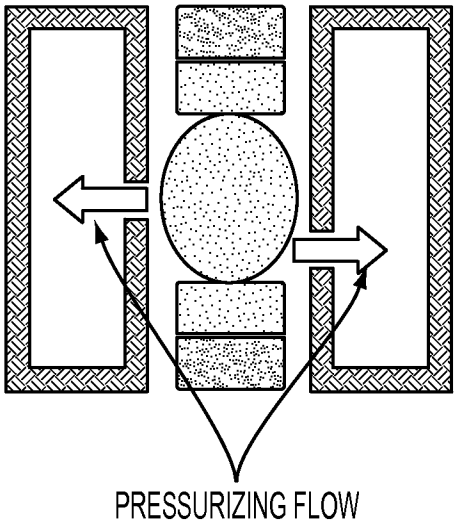

Referring now to FIG. 4, a graph illustrating the relationship between a current and time during a fault in a circuit breaker with an expansion chamber in accordance with an exemplary embodiment is shown. During the rising portion of the current, the pressure in the arcing space is higher than the pressure in the expansion chamber, and hence flow is generated to push hot gas into the expansion chamber, as shown in FIG. 5A. During the rising current phase the pressure in the expansion chamber is built up to match the pressure in the arcing space. In exemplary embodiments, the gas inside the expansion chamber is cooled and de-ionized due to lack of heating in the chamber. In exemplary embodiments, the chamber may contain one or more cooling elements to aide in the cooling of the gas in the chamber.

After current in the arc reaches peak value, the pressure in the arcing space starts to reduce. At a certain point of time, the pressure in the expansion chamber exceeds the pressure in the arcing space and an air flow is generated that blows cooled gas from the expansion chamber into the arcing space, as shown in FIG. 5B. In exemplary embodiments, the volume of the expansion chamber and the size of the opening are selected such that the reverse flow can last until the current flow in the arc reaches the natural zero crossing, and hence significantly increase the dielectric strength of the arcing space to prevent re-ignition. In exemplary embodiment, the flowing of cooled air on the arc also cools down the arc and increases the arc voltage, thereby providing better current limiting performance.

Figures 6A, 6B, 6C, 6D:
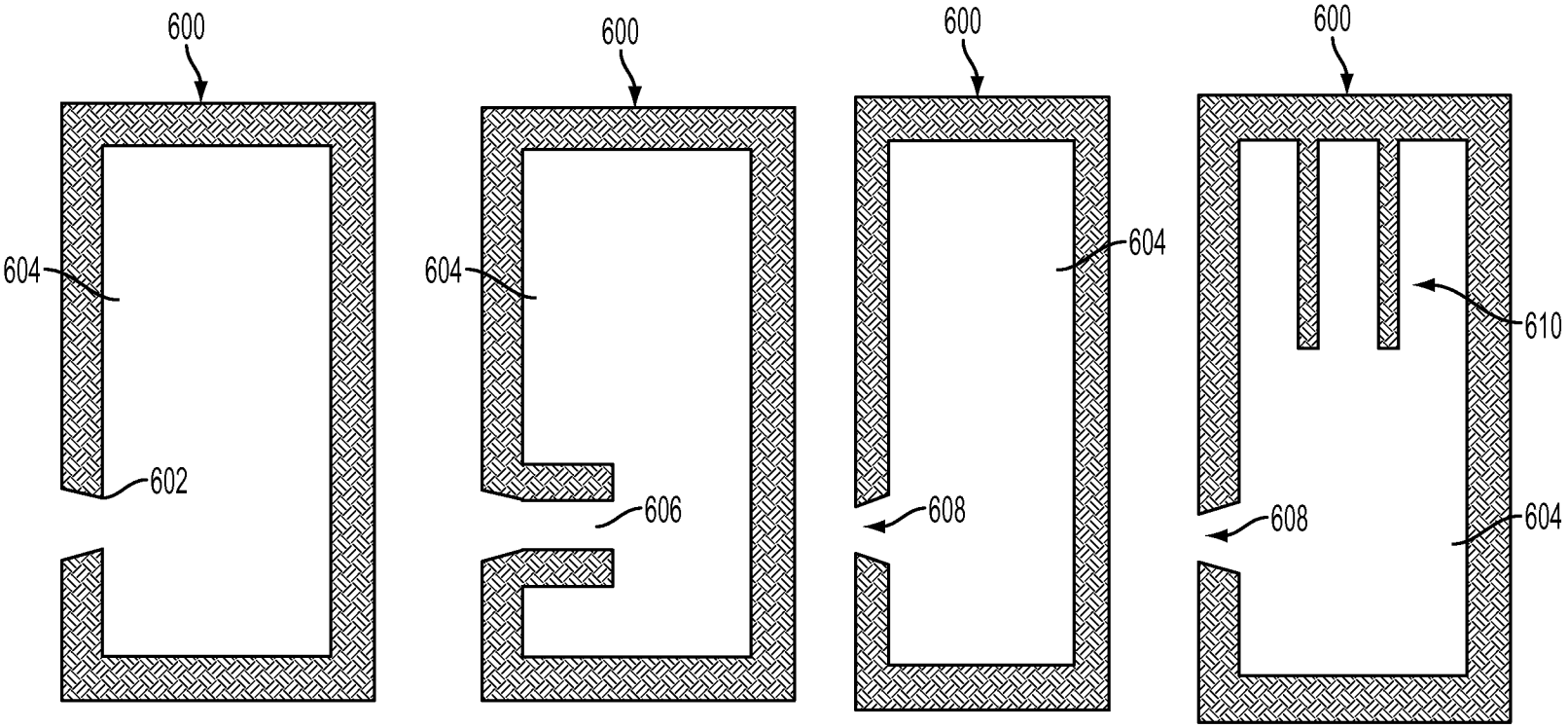
FIGS. 6A, 6B, 6C and 6D illustrate cross sectional side views of expansion chambers in accordance with exemplary embodiments.

FIGS. 6A, 6B and 6C illustrate cross sectional side views expansion chambers 600 in accordance with various exemplary embodiments. As illustrated each of the expansion chambers 600 includes a chamber 604 configured to receive pressurized air from an arcing space through an opening. The expansion chambers 600 may include openings that have different cross sectional shapes to achieve different flow profiles. For example, the openings may be configured in the shape of a converging nozzle. The converging nozzle is used to accelerate the airflow through the opening. While the mass flow rate is defined by the smallest cross section, the velocity of the flow can be a lot higher than just straight channel. As shown in FIGS. 6A and 6B, openings 602, 606 may be used to enable fast pressurizing of the expansion chamber 600 and slow releasing of reverse flow from the expansion chamber 600. For example, the openings 602, 606 may include a tapered shape that reduces in size from the arcing space into the chamber 604. As shown in FIG. 6C, opening 608 may be used to achieve fast releasing and for a strong reverse flow into the arcing space from the chamber 604. For example, the openings 608 may include a tapered shape that increases in size from the arcing space into the chamber 604.

Referring now to FIG. 6D a cross sectional side view of an expansion chamber 600 in accordance with an exemplary embodiment is shown. In exemplary embodiments, the chamber 604 may include on or more cooling elements 610, such as fins, disposed within the chamber 604. The cooling elements 610 may be formed from the same or different material than the expansion chamber 600. It will be appreciated by those of ordinary skill in the art that the arrangement of cooling elements depicted is merely exemplary and that the number, size and location of the cooling elements 610 may be varied based on the desired operational characteristics of the expansion chamber 600 and the circuit breaker.

Figures 7A, 7B, 7C:
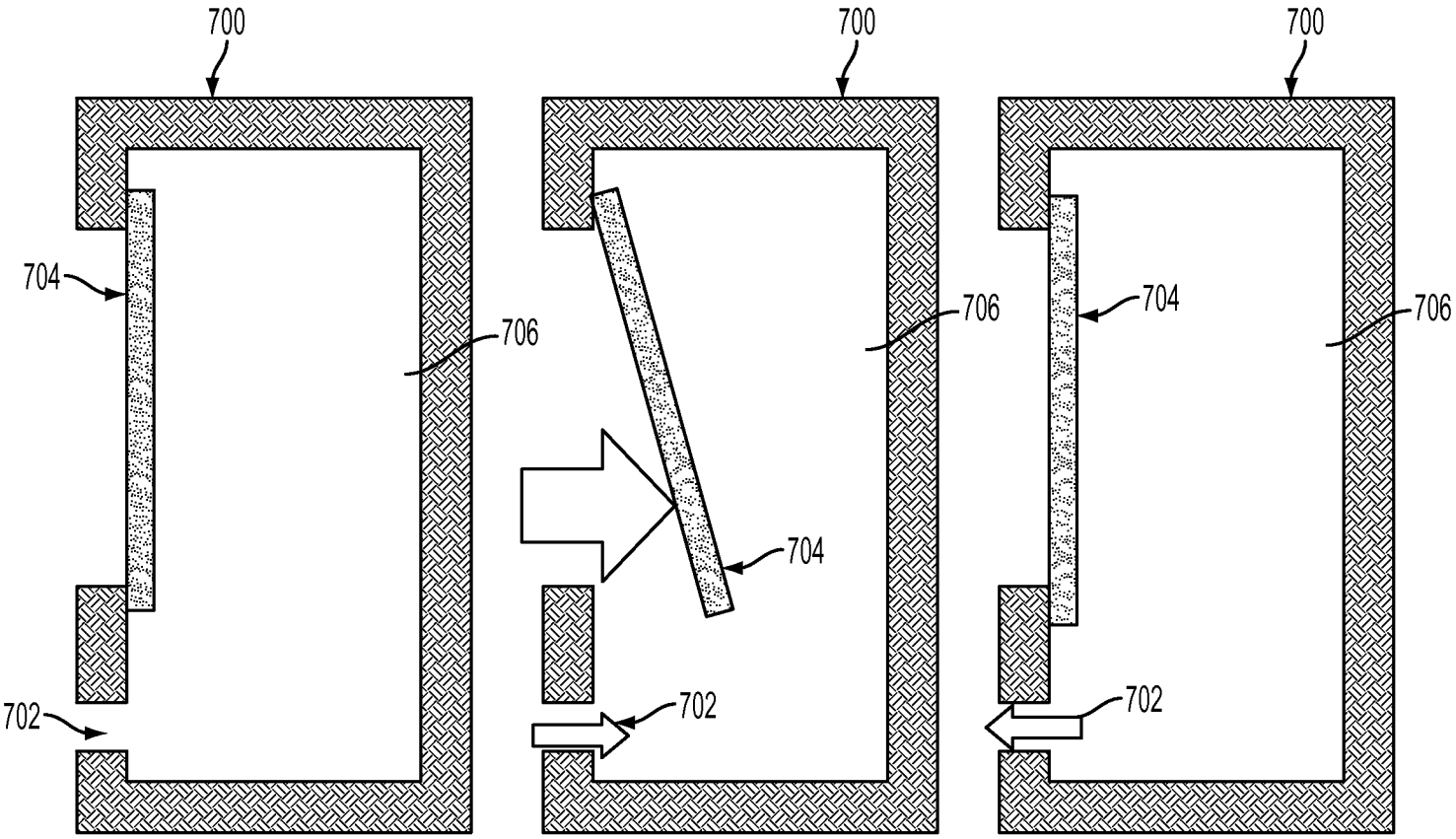
FIGS. 7A, 7B and 7C illustrate cross sectional side views of expansion chambers in accordance with an exemplary embodiment.

Referring now to FIGS. 7A, 7B and 7C cross sectional side views of expansion chambers 700 in accordance with an exemplary embodiment are shown. As illustrated, the expansion chambers 700 include an opening 702, a chamber 706 and a one-way valve 704. In some embodiments a fast pressurizing air flow from an arcing space into the chamber 706 and a slow air flow releasing air from the chamber 706 into the arcing space are desired. In exemplary embodiments, the one-way valve 704 can be added to the expansion chamber 700 to accomplish these air flow characteristics.

As shown in FIG. 7B, when the pressure in the arcing space is rising the one-way valve 704 is opened and air flows into the chamber 706 through both the one-way valve 704 and the opening 702. As a result, the pressure in the chamber 706 is able to rapidly increase as the pressure in the arcing space is increasing. Next, as shown in FIG. 7C, when the pressure in the arcing space in less than the pressure in the chamber 706 the one-way valve is closed. As a result, the air from the chamber is only released through the opening 702. In exemplary embodiments, the one-way valve 704 may include a flexible member attached to the inside the chamber 706. In exemplary embodiments, a slow pressurizing air flow from an arcing space into the chamber and a fast air flow releasing air from the chamber can be achieved using a one-way valve with an opposite configuration from that shown in FIGS. 7A, 7B and 7C can be used.

Figure 8B:
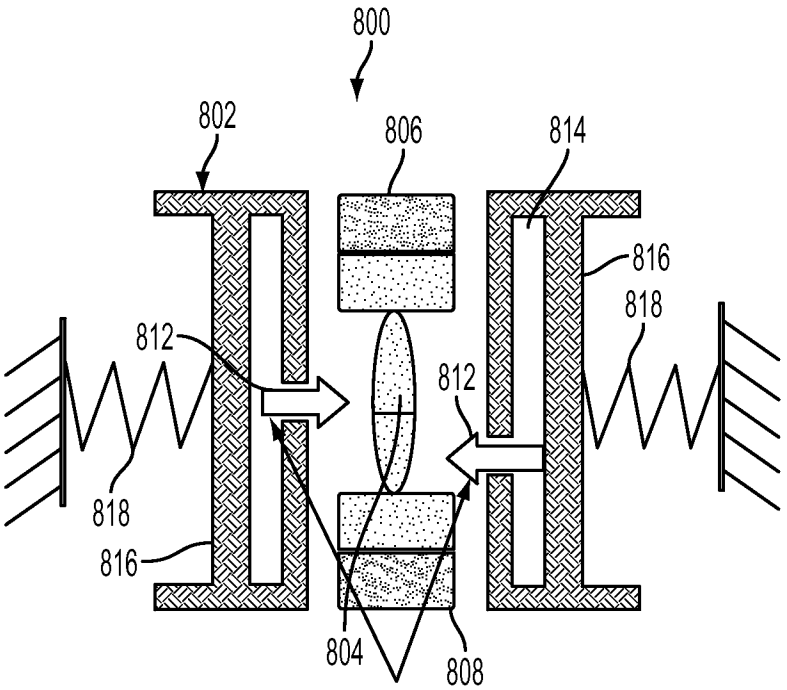
FIGS. 8A and 8B illustrate cross sectional side views of a circuit breaker with an expansion chamber in accordance with an exemplary embodiment.
Figure 8A:
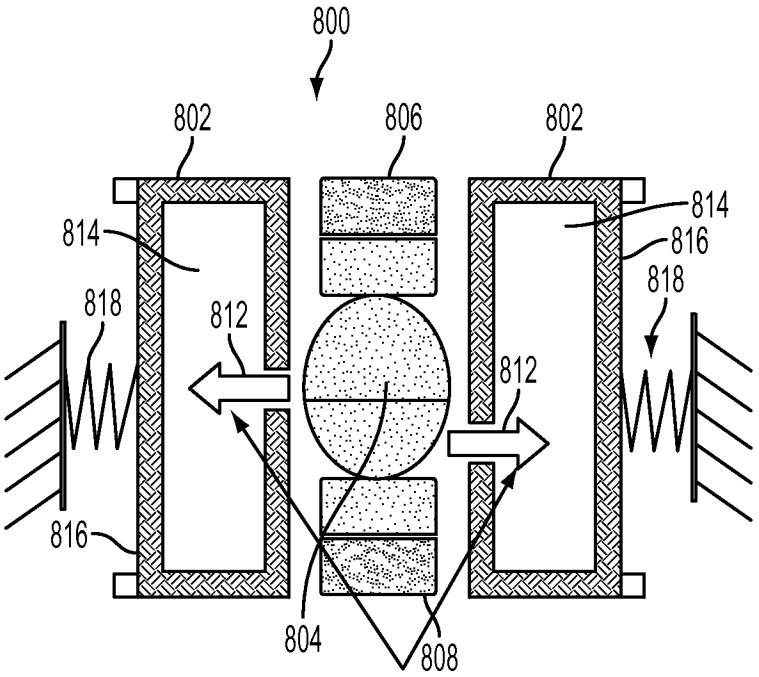

Referring now to FIGS. 8A and 8B, cross sectional side views of a portion of circuit breaker 800 with expansion chambers 802 in accordance with an exemplary embodiment are shown. As illustrated, the circuit breaker 800 includes an arcing space 804 which is disposed between a stationary contact 808, a moveable contact 806 and the expansion chambers 802. Each of the expansion chambers 802 includes an opening 812 configured to allow airflow in between the chamber 814 of the expansion chambers 802 and the arcing space 804.

In exemplary embodiments, each of the expansion chambers 802 also includes a moveable wall 816 that is configured to move under pressure to allow the expansion and contraction of the chamber 814. In exemplary embodiments, the moveable wall 816 may be affixed to a spring 818 which is configured to assure a minimum air flow rate from the chamber 814 into the arcing space 804, which is related to the characteristics of the spring 818. In exemplary embodiments, the moveable wall 816 may be actuated with external springs 818, as shown, or by using flexible members as chamber walls.

FIGS. 8A and 8B illustrate circuit breakers 800 including two expansion chambers 802 with staggered opening 812. In exemplary embodiments, the staggered openings 812 increase the working area of the reverse flows on the arc in the arcing space. In exemplary embodiments, multiple openings in each expansion chamber 802 can be used to cover more arc length. In alternative embodiments, the circuit breaker may include only one expansion chamber that can have one or more openings.

Figure 9:
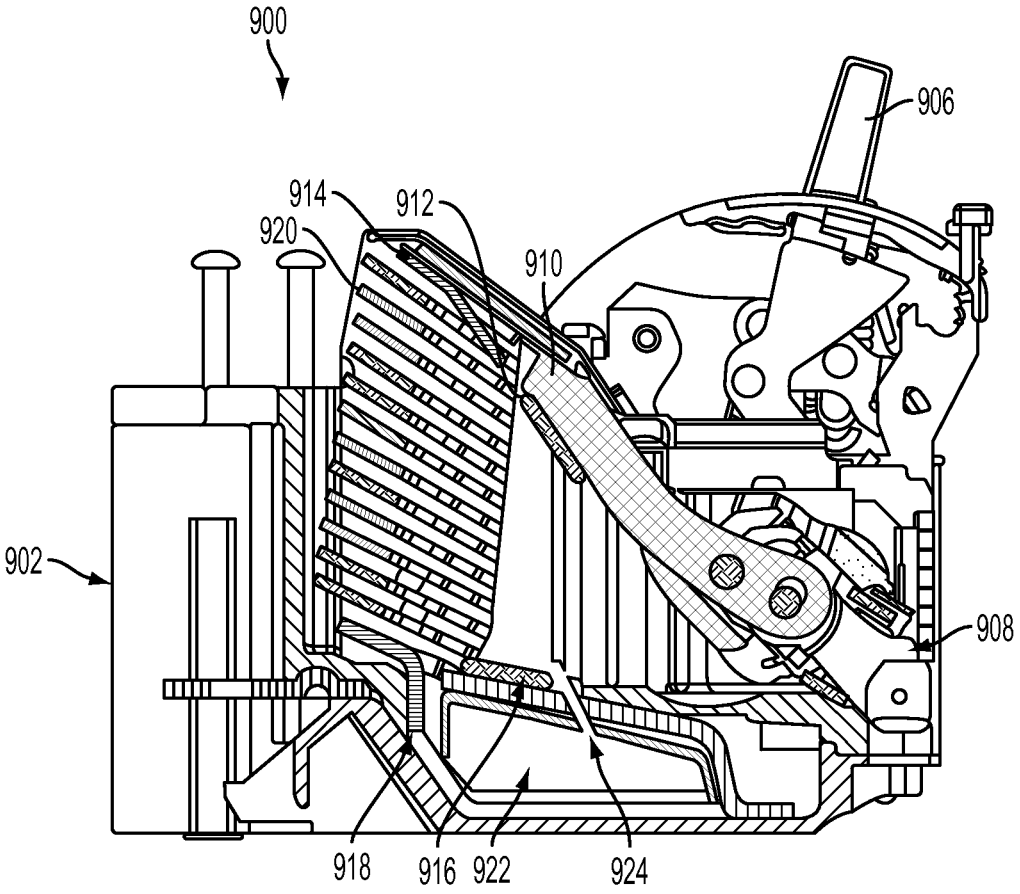
FIG. 9 illustrates a cross sectional side view of a circuit breaker with an expansion chamber in accordance with an exemplary embodiment.

Referring now to FIG. 9, a cross sectional side view of a circuit breaker 900 with an expansion chamber 922 in accordance with an exemplary embodiment is shown. The circuit breaker 900 includes a housing 902 that may be made up of a number of interconnecting housing sections and may include an arrangement of internal and external walls, which are adapted to contain or retain various components of the circuit breaker 900. In exemplary embodiments, the circuit breaker 900 includes a handle 906 that is operably connected to an operating mechanism 908. The operating mechanism 908 is coupled to an arm 910 that has a moveable contact 912 and an upper arc runner 914 disposed thereon. The circuit breaker 900 also includes a stationary contact 916 and a lower arc runner 918. In exemplary embodiments, the circuit breaker 900 includes a plurality of arc plates 920. In exemplary embodiments, the circuit breaker 900 also includes an expansion chamber 922 disposed beneath the stationary contact 916. The expansion chamber 922 includes an opening 924 that is disposed adjacent to the stationary contact.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The components and materials described hereinafter as making up the various embodiments are intended to be illustrative and not restrictive. Many suitable components and materials that would perform the same or a similar function as the materials described herein are intended to be embraced within the scope of embodiments of the present invention. While embodiments of the present invention have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A circuit breaker comprising:

first and second electrical contacts, the contacts adapted to generate an electrical arc during separation, at least one of the first and second electrical contacts being a movable electrical contact; and an expansion chamber disposed adjacent to at least one of the first and second electrical contacts such that an arcing space is defined by the first electrical contact and the second electrical contact when the first and second electrical contacts are separated, wherein the expansion chamber includes an opening configured to permit air flow between the arcing space and a chamber of the expansion chamber and further includes a one-way valve configured to permit either a higher rate of air flow from the arcing space into the chamber of the expansion chamber than from the chamber of the expansion chamber into the arcing space or a lower rate of air flow from the arcing space into the chamber of the expansion chamber than from the chamber of the expansion chamber into the arcing space.

2. The circuit breaker of claim 1, further comprising a second expansion chamber disposed adjacent to the first and second electrical contacts and opposite the expansion chamber, the second expansion chamber having a second opening that is staggered from the opening of the expansion chamber.

3. The circuit breaker of claim 1, wherein the expansion chamber further comprises one or more cooling elements disposed with the chamber.

4. The circuit breaker of claim 1, wherein the expansion chamber further comprises a second opening configured to permit air flow between the arcing space and the chamber of the expansion chamber.

5. The circuit breaker of claim 1, wherein the opening of the expansion chamber has a shape configured to permit a higher rate of air flow from the arcing space into the chamber of the expansion chamber than from the chamber of the expansion chamber into the arcing space.

6. The circuit breaker of claim 1, wherein the opening of the expansion chamber has a shape configured to permit a lower rate of air flow from the arcing space into the chamber of the expansion chamber than from the chamber of the expansion chamber into the arcing space.

7. A circuit breaker comprising:

first and second electrical contacts, the contacts adapted to generate an electrical arc during separation, at least one of the first and second electrical contacts being a movable electrical contact; and an expansion chamber disposed adjacent to at least one of the first and second electrical contacts such that an arcing space is defined by the first electrical contact and the second electrical contact when the first and second electrical contacts are separated, wherein the expansion chamber includes an opening configured to permit air flow between the arcing space and a chamber of the expansion chamber and further includes one or more moveable walls that permit a volume of the chamber to increase and decrease in response to a change in pressure in the arcing space.

8. The circuit breaker of claim 7, further comprising a second expansion chamber disposed adjacent to the first and second electrical contacts and opposite the expansion chamber, the second expansion chamber having a second opening that is staggered from the opening of the expansion chamber.

9. The circuit breaker of claim 7, wherein the expansion chamber further comprises a second opening configured to permit air flow between the arcing space and the chamber of the expansion chamber.

10. The circuit breaker of claim 7, wherein the expansion chamber further comprises one or more cooling elements disposed with the chamber.

11. The circuit breaker of claim 7, wherein the opening of the expansion chamber has a shape configured to permit a higher rate of air flow from the arcing space into the chamber of the expansion chamber than from the chamber of the expansion chamber into the arcing space.

12. The circuit breaker of claim 7, wherein the opening of the expansion chamber has a shape configured to permit a lower rate of air flow from the arcing space into the chamber of the expansion chamber than from the chamber of the expansion chamber into the arcing space.

13. A method of operating a circuit breaker, comprising:

separating a first electrical contact from a second electrical contact upon tripping of the circuit breaker, and responsively forming an electrical arc, wherein at least one of the first and second electrical contacts is a moveable electrical contact;

increasing an air pressure in an expansion chamber disposed adjacent to at least one of the first and second electrical contacts in response to a rising current in the electrical arc, wherein an arcing space is defined by the first electrical contact and the second electrical contact when the first and second electrical contacts are separated, and wherein the expansion chamber comprises one of (1) a one-way valve configured to permit a higher rate of air flow from the arcing space into the chamber of the expansion chamber than from the chamber of the expansion chamber into the arcing space, (2) a one-way valve configured to permit a lower rate of air flow from the arcing space into the chamber of the expansion chamber than from the chamber of the expansion chamber into the arcing space, or (3) one or more moveable walls that permit a volume of the chamber to increase and decrease in response to a change in pressure in the arcing space; and creating an airflow from the expansion chamber into the arcing space through an opening in the expansion chamber in response to a decrease in the air pressure in the arcing space, wherein the airflow acts to cool the electrical arc.

14. The method of claim 13, further comprising:

increasing an air pressure in a second expansion chamber disposed adjacent to the first and second electrical contacts in response to the rising current in the electrical arc, creating an airflow from the second expansion chamber into the arcing space through a second opening in the second expansion chamber in response to the decrease in the air pressure in the arcing space, wherein the airflow acts to cool the electrical arc, wherein the second opening that is staggered from the opening of the expansion chamber.

15. The method of claim 13, wherein the expansion chamber further comprises one or more cooling elements disposed with the chamber.

16. The method of claim 13, wherein the expansion chamber further comprises a second opening configured to permit air flow between the arcing space and the chamber of the expansion chamber.

17. The method of claim 13, wherein the opening of the expansion chamber has a shape configured to permit a higher rate of air flow from the arcing space into the chamber of the expansion chamber than from the chamber of the expansion chamber into the arcing space.

18. The method of claim 13, wherein the opening of the expansion chamber has a shape configured to permit a lower rate of air flow from the arcing space into the chamber of the expansion chamber than from the chamber of the expansion chamber into the arcing space.

* * * * *